US010526057B2

(12) United States Patent
Kohnsen

(10) Patent No.: US 10,526,057 B2
(45) Date of Patent: Jan. 7, 2020

(54) WATER SPORTS DEVICE

(71) Applicant: SOPHIA VERWALTUNGS GMBH, Rastatt (DE)

(72) Inventor: Benjamin Kohnsen, Scharbeutz (DE)

(73) Assignee: Lampuga GmbH, Rastatt (DE)

( * ) Notice: Subject to any disclaimer, the term of this patent is extended or adjusted under 35 U.S.C. 154(b) by 45 days.

(21) Appl. No.: 15/579,279

(22) PCT Filed: Jun. 2, 2016

(86) PCT No.: PCT/EP2016/062516

§ 371 (c)(1),
(2) Date: Dec. 4, 2017

(87) PCT Pub. No.: WO2016/193382

PCT Pub. Date: Dec. 8, 2016

(65) Prior Publication Data

US 2018/0178886 A1 Jun. 28, 2018

(30) Foreign Application Priority Data

Jun. 3, 2015 (DE) ..... 10 2015 108 863

(51) Int. Cl.

| | |
|---|---|
| ***B63B 35/79*** | (2006.01) |
| ***B63B 7/08*** | (2006.01) |
| ***B63H 11/00*** | (2006.01) |

(52) U.S. Cl.

CPC ..... *B63B 35/7943* (2013.01); *B63B 7/082* (2013.01); *B63B 35/7913* (2013.01); *B63H 11/00* (2013.01)

(58) Field of Classification Search

CPC . B63B 7/082; B63B 35/7913; B63B 35/7943; B63H 11/00

See application file for complete search history.

(56) References Cited

U.S. PATENT DOCUMENTS 3,659,546 A * 5/1972 Miklos ..... B63B 35/34 114/246
4,347,801 A * 9/1982 Colin ..... B63B 35/70 114/248

(Continued)

FOREIGN PATENT DOCUMENTS

DE 2155978 A1 * 5/1973 ..... B63B 35/7913
DE 202017107820 U1 * 1/2018 ..... B63B 35/7913

(Continued)

*Primary Examiner* — Ajay Vasudeva
(74) *Attorney, Agent, or Firm* — Bay State IP, LLC

(57) ABSTRACT

The invention relates to a water sports device comprising an inflatable body component (1) having a longitudinal direction (L) and inflatable arms (8*a*, 8*b*) on a rear end, the arms being distanced from one another and orientated in the longitudinal direction (L), between which arms a receptacle (2) having an inner contour is formed, and comprising a drive component (7) having a tread surface (4) and an underwater surface (3), which drive component is formed with a complimentary contour (10*a*, 10*b*, 11) on two longitudinal sides (10*a*, 10*b*) that are distanced from one another and which component can be inserted into the receptacle (2) from the rear end, wherein the inner contour and the complimentary outer contour (10*a*, 10*b*, 11) form a connection to one another and a position of the inserted drive component (7) in the receptacle (2) is secured in the direction of the tread surface.

10 Claims, 3 Drawing Sheets

(56) References Cited

U.S. PATENT DOCUMENTS

Figure 1:
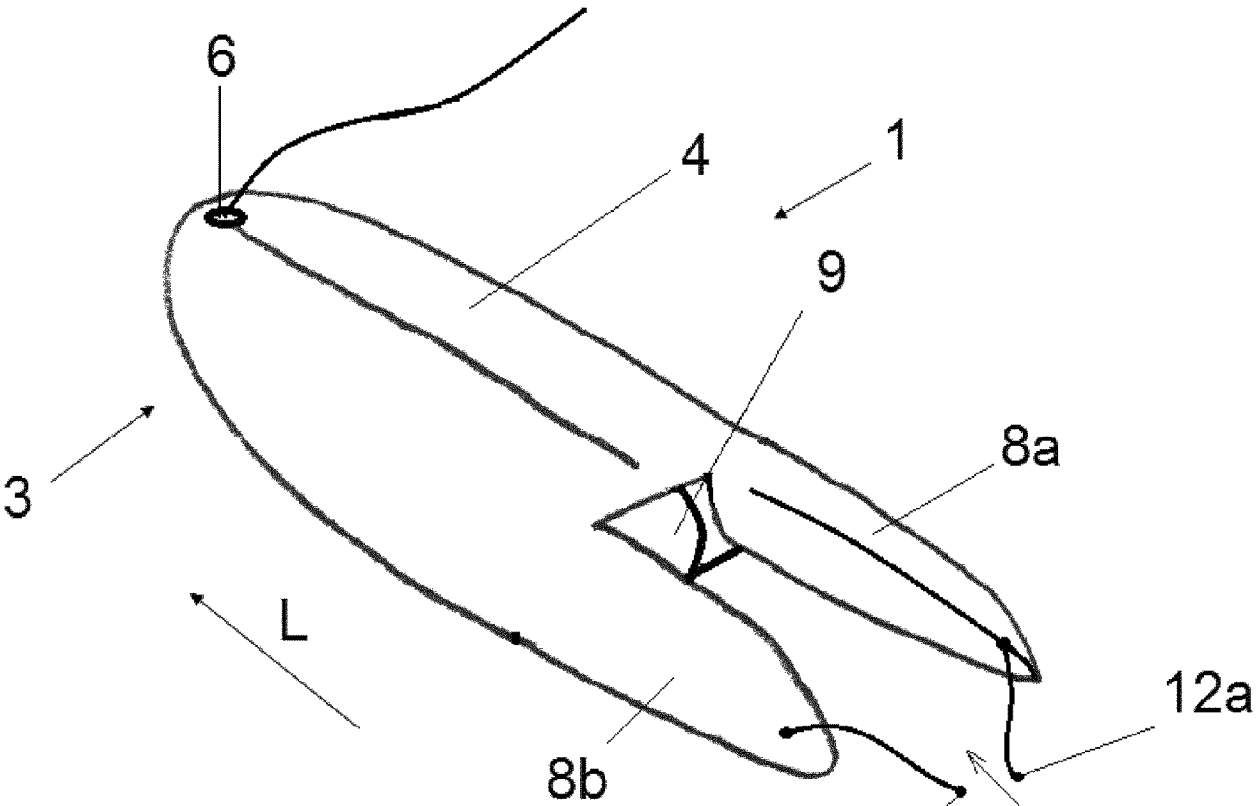

| | | | | | |
|---|---|---|---|---|---|
| 4,694,770 | A * | 9/1987 | Kitner | B63B 35/731 | 114/123 |
| 4,811,682 | A * | 3/1989 | Hwang | B63B 7/087 | 114/345 |
| 5,184,564 | A * | 2/1993 | Robbins | B63B 7/082 | 114/345 |
| 5,282,437 | A * | 2/1994 | Avillez de Basto | B63B 35/731 | 114/345 |
| 6,135,047 | A * | 10/2000 | Miller | B63B 29/04 | 114/248 |
| 8,230,800 | B1 * | 7/2012 | Wing | B63B 43/14 | 114/123 |
| 9,738,359 | B2 * | 8/2017 | Falkman | B63B 7/06 | |
| 2001/0032578 | A1 * | 10/2001 | Mcauliffe | B63B 59/02 | 114/345 |
| 2013/0059489 | A1 | 3/2013 | Vlock | | |

FOREIGN PATENT DOCUMENTS

| | | | | | |
|---|---|---|---|---|---|
| JP | 2002193185 | A * | 7/2002 | | |
| JP | 2003026085 | A * | 1/2003 | | |
| WO | WO-2018149044 | A1 * | 8/2018 | B63B 35/7913 | |

* cited by examiner

WATER SPORTS DEVICE

CROSS REFERENCE TO RELATED APPLICATION

This application is for entry into the U.S. National Phase under § 371 for International Application No. PCT/EP2016/062516 having an international filing date of Jun. 2, 2016, and from which priority is claimed under all applicable sections of Title 35 of the United States Code including, but not limited to, Sections 120, 363, and 365(c), and which in turn claims priority under 35 USC 119 to German Patent Application No. 10 2015 108 863.0 filed on Jun. 3, 2015.

The invention relates to a water sports device.

Water sports devices, for example in the form of surfboards, have long been known in the prior art, for example from DE 20 2011 051071.9. On said surfboard, a fixed hull is provided and a jet drive is installed in the stern section thereof. The jet drive is controlled by means of a remote control. The surfboard is heavy and bulky and therefore can be transported only with difficulty.

WO 2013/036536 A2 discloses both an inflatable dinghy with a drive unit and also a surfboard which has in its middle part a selectively usable drive unit or an underwater surface unit which seals the underwater surface. It is a disadvantage that this inflatable surfboard can be controlled only with difficulty, and in addition the efficiency of a jet drive located in the middle of the surfboard is not high because the incoming water has to be deflected again below the water surface.

It is therefore an object of the present invention to provide a surfboard which avoids the aforementioned disadvantages.

The object is achieved by a water sports device of the type mentioned above which has the features of claim 1.

The invention makes use of the concept of splitting an inflatable water sports device into two parts, namely an inflatable hull component and a drive component, wherein the drive component has an electric drive and forms a stern of the water sports device or at least contributes to forming the latter. The water sports device can thus be transported more easily. Due to the drive component being formed as the stern of the water sports device, the water sports device is particularly easy to control and is highly efficient.

Advantageously, the hull component and the drive component are detachably connected to one another, that is to say the drive component can be inserted into the inflated hull component but can also be detached again therefrom and inserted into a different hull component having a suitable receptacle. As a result, it is advantageously possible that the drive component, which is expensive to purchase, can be combined with a plurality of hull components, which are considerably less expensive to purchase.

According to the invention, the water sports device comprises an inflatable hull component having a longitudinal direction and, at a stern end, inflatable arms which are spaced apart from one another and which are oriented in the longitudinal direction, said arms forming therebetween a receptacle having an inner contour.

The water sports device also comprises the drive component having a tread surface and an underwater surface, which drive component is formed with a complementary outer contour on two spaced-apart longitudinal sides and can be inserted into the receptacle from the stern end, and the inner contour and the complementary outer contour form a connection with one another, namely in such a way that a position of the drive component in the receptacle is fixed in the direction of the tread surface, that is to say in the upward direction, and in the direction of the underwater surface, that is to say in the downward direction, and laterally, that is to say in the starboard and port direction.

The connection may comprise a form-fitting connection or clamping connection. After insertion, the drive component is fixed in the receptacle, with the exception of the insertion direction, without further means. The connection may also be a pure clamping connection, which is additionally fixed counter to the insertion direction.

After insertion, the movement counter to the insertion direction is prevented by at least one fastening means. To this end, at least one fastening means is provided for fastening the drive component in the receptacle, which fastening means can be opened and closed at the stern end of the drive component and of the arms and prevents the drive component from slipping out of the receptacle at the stern end.

The shape of the inner contour and of the outer contour can be very diverse. All that is important is that the two contours hook into one another and/or additionally become jammed and prevent both lateral and upward and downward slipping of the drive component and hold the drive component in position in this respect.

In one particularly preferred embodiment of the invention, the hull component is made of a drop stitch material. The drop stitch material is produced in the drop stitch method, in which two or more plastic fabric webs, preferably denier polyester fabric webs, are placed on top of one another. The two plastic fabric webs are connected to one another by a large number, that is to say thousands, of polyester threads. The two fabric webs are held at a distance from one another so that the space filled with polyester threads between the fabric webs can later be filled with compressed air. The polyester threads are sewn to the two fabric webs on both sides by means of a drop-down stitch sewing machine for example. The two fabric webs which have been sewn together form the support framework which imparts mechanical strength to the hull component in the inflated state.

The two fabric webs which are connected to one another are cut to the desired shape. The top and bottom fabric webs are coated with PVC layers, preferably with three layers, and are compressed as layers and adhesively bonded. The sides are adhesively bonded in an overlapping manner using a seam tape and are compressed, so that the airtight hull component is formed.

The drop stitch method makes it possible to manufacture the inflatable hull component with excellent mechanical strength properties, which withstand both high tensile stresses and also compressive stresses and shear stresses.

The drop-stitch outer skin of the inflatable hull component is airtight and in the inflated state is extremely stable against deformation, so that a surfer can stand on the hull component and can surf while the outer shape of the inflated hull component is maintained. The hull component is filled with high pressure. The filling may take place by means of a compressor. The compressor can be supplied with energy from the battery installed in the surfboard.

The hull component made of the drop stitch material is preferably low in noise because the sound level which is generated by the breaking of waves, but also by propulsion, is damped by the hull. The hull component exhibits little vibration during operation because vibrations are reduced by the drop stitch material. Since the hull is slightly deformable, shocks caused by waves, etc. are advantageously absorbed. Furthermore, it is advantageous that the softer hull in comparison to conventional surfboards causes fewer injuries if the surfboard collides with the surfer in the event of the surfer falling.

Preferably, a tread surface of the add-on part is flush with a tread surface of an inflated hull component, so that a common total tread surface is formed by the hull component and the drive component. To this end, the drive component should be able to be inserted into the cutout with a form fit and without any gaps being formed.

Advantageously, the underwater surface of the drive component is also flush with an underwater surface of the inflated hull component, so that a smooth underwater surface is formed over the entire longitudinal extension of the surfboard, thereby promoting skimming of the surfboard.

According to the invention, the inflatable hull component has, at a stern end, inflatable arms which are spaced apart from one another and which are oriented in a longitudinal direction, said arms forming the receptacle therebetween and each being convex on their mutually facing inner sides in a cross-section perpendicular to the longitudinal direction.

The water sports device also comprises the drive component, which fits into the receptacle with a form fit and is concave on two spaced-apart longitudinal sides so that the concave longitudinal sides engage at least partially around the convex arms with a form fit.

At least one fastening means which can be opened and closed for fastening the drive component in the receptacle is provided at the stern end of the drive component and of the arms. This facilitates replacement of the drive component.

The configuration of the receptacle as two inflatable arms which are convex on an inner side in cross-section makes it possible to dispense with a rail mechanism or a box-shaped receptacle or further fastening means on the inner side of the receptacle. On account of its concave design, the drive component can easily be inserted into the receptacle from the stern end, and the drive component is arranged in a fixed position in the cutout.

Preferably, the concave longitudinal side of the drive component engages around the arms to an extent of at least one-third, preferably more than one-third, so that the drive component cannot slip out of the receptacle in the upward direction, that is to say on the tread surface side, or in the downward direction, that is to say on the water surface side.

Preferably, the inner side of the receptacle is U-shaped and is concave, preferably shaped as a sector of a circle, preferably shaped as a semicircle, along the entire U-shape, and the outer sides of the drive component are likewise concave, preferably in the shape of a semicircle, between a tread surface and an underwater surface along a surface which is in contact with the cutout and which is U-shaped in horizontal cross-section, so that the concave U-shaped indentation of the drive component fits into the convex U-shaped bulge of the cutout of the hull component with a form fit when the hull component is firmly inflated.

According to the invention, fastening means for fastening the drive component in the receptacle are provided preferably at the stern end both of the drive component and of the arms. The fastening means may be of varying type; it may be a snap fastener, clip fastener or the like which is provided in the arm in each case and which can be placed around an arm arranged on the drive component. It is also conceivable that an elastic strap with a thickened end is provided on each of the arms, and a respective fork is provided on the drive component at the stern end, into which the thickened ends can be inserted, whereby the thickened ends engage behind the fork and pull the drive component into the cutout under the effect of tension.

In one preferred embodiment of the invention, it is provided that the drive component comprises a jet drive with a rechargeable battery, that is to say an accumulator. Particularly in this embodiment of the invention, it is also preferred to configure the drive component in the form of two chambers which are arranged one behind the other in the longitudinal direction and which can be detached from one another, each of the chambers being impervious to water. At least the electrical components are encapsulated against contact with water. The accumulator is preferably provided in the chamber arranged towards the bow, and the jet drive is preferably provided in the chamber towards the stern. The two chambers can preferably be plugged into one another by means of mechanical and electrical plug-in connections, and separating surfaces of the two chambers are pressed against one another by the fastening mechanism, which exerts a force in the direction of the bow of the water sports device, and thus are held against one another in a slip-resistant manner by the mechanical fastening means. Further latching mechanisms, such as screw connections, etc., are, however, not necessary, so that easy dismantling of the drive component is possible. In particular, after the jet drive chamber has been detached, the accumulator chamber can be removed and replaced with a new accumulator chamber containing a charged accumulator, so that it is possible to keep the water sports device constantly in operation, it being possible for the accumulator chambers to be charged alternately during operation of the water sports device and, once the accumulator that is in operation is empty, it can be replaced with an accumulator that has already been recharged.

Figure 3:
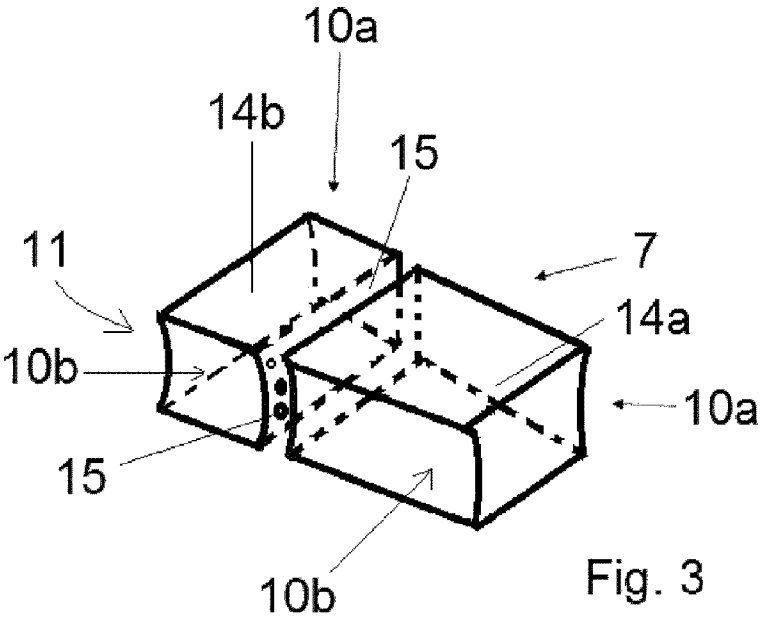
Figure 2:
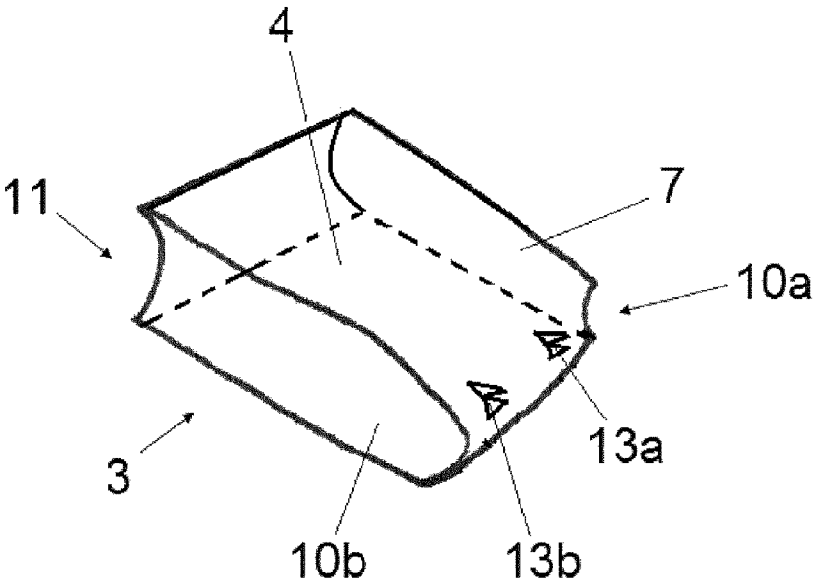
Figure 4:
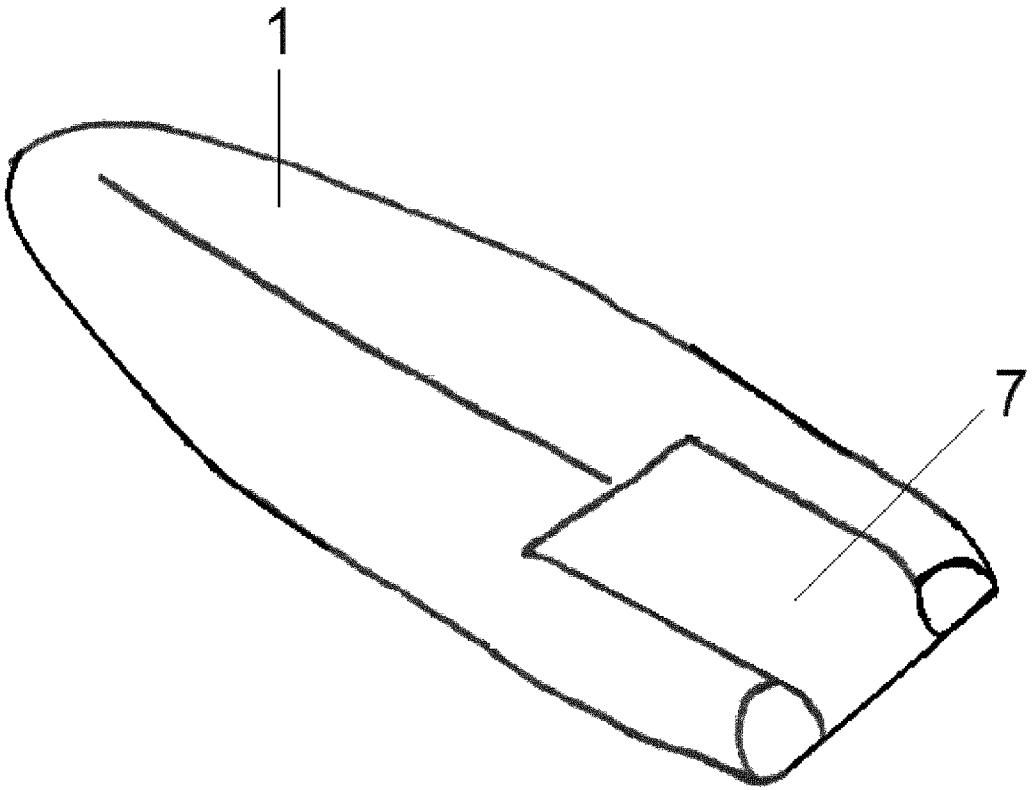

The invention will be described on the basis of exemplary embodiments in four figures, in which:

FIG. 1 shows an inflatable surfboard according to the invention with a receptacle for a drive component according to the invention, FIG. 2 shows a one-part drive component according to the invention, FIG. 3 shows a two-part drive component according to the invention, FIG. 4 shows a surfboard according to the invention.

FIG. 1 shows an inflated hull component 1 of the surfboard according to the invention. The hull component 1 has a longitudinal direction L which extends from the stern of the hull component 1 to a bow of the hull component 1. A cutout 2 is provided in the stern of the hull component 1. The hull component 1 has an underwater surface 3 and a tread surface 4, which forms part of an above-water surface. A surfer stands with his feet on the tread surface 4 while surfing, or kneels on the tread surface 4. Provided at the bow of the hull component 1 is an eyelet 6 for a grab line, by which the surfer can hold on with one hand while surfing. In another hand, the surfer holds a controller (not shown) for a drive component 7 according to FIG. 2 or FIG. 3. The drive component 7 comprises a jet drive and an accumulator.

The speed of the surfboard can be changed by means of the controller; to this end, the controller has, for example, a pistol grip. Turning manoeuvres are initiated by the surfer shifting his weight on the surfboard.

The hull component 1 is made of a drop stitch material. A drop stitch material is to be understood to mean an air-permeable fabric with stabilizing longitudinal threads. The cutout 2 at the stern of the hull component 1 is open counter to the direction of travel, which is usually oriented in the longitudinal direction L, that is to say the cutout 2 is substantially U-shaped. At the side, the cutout 2 has arms 8*a*, 8*b* which run in the longitudinal direction L and which are approximately circular in cross-section. The arms are circular in cross-section along their entire longitudinal extension. The two arms 8*a*, 8*b*, which are oriented in the longitudinal direction L, form the two U-limbs of the U-shaped cutout.

The U-bottom of the cutout 2 is formed by a bead 9 which is semicircular in cross-section perpendicular to the longitudinal direction L. An inner side of the U-shaped cutout 2 is therefore curved inwards, that is to say is convex, along the entire U-shaped inner side of the cutout.

The hull component 1 is shown in the inflated state in FIG. 1, but the drive component 7 is not inserted in the inflated hull component 1. The hull component 1 in FIG. 1 is around 1 m to 4 m long and between 0.7 m and 1 m wide. The hull component 1 can be inflated with air, and air can also be discharged again therefrom.

FIG. 2 shows the drive component 7, which with its external dimensions is precisely adapted to the internal dimensions of the cutout 2 of the hull component 1 and can be inserted into the cutout 2 with a form fit. The drive component 7 comprises a jet drive which is not shown and which can be supplied with power by way of an accumulator. A fin may be provided on an underwater surface 3 of the drive component 7.

The jet drive has a water inlet (not shown) on the underwater surface 3 of the drive component 7 and a water outlet at the stern of the drive component 7. A propeller is provided in a water channel connecting the water inlet and water outlet. A nozzle is arranged at the water outlet, through which nozzle the water is sprayed out rearwards counter to the direction of travel, thereby propelling the surfboard forward. With the drive component 7 inserted in the hull component 1, the surfer standing on the surfboard can vary the speed or the rate of advance by means of the hand-held controller and can initiate and execute turning manoeuvres by shifting his weight. A position of the nozzle could also be controlled using the controller, and the position of the fin could also be controlled using the controller. However, both are not necessarily the case.

The drive component 7 fits into the cutout 2 with a form fit, wherein lateral outer walls 10*a*, 10*b* and a bow-side outer wall 11, which are arranged between the underwater surface 3 and the tread surface 4 of the drive component 7, are together likewise U-shaped and are concave around the U so that the drive component 7 can be pushed into the cutout 2 of the hull component 1 from the stern in the longitudinal direction L and establishes a form-fitting connection with the hull component 1. The inflated hull component 1 has such a strength that the drive component 7 is held in the hull component 1 in a very stable manner on account of the fact that the concave lateral outer walls 10*a*, 10*b* engage partially around the associated arms 8*a*, 8*b* and the bow-side outer wall 11 engages partially around the bead 9.

To prevent the drive component 7 from slipping out of the cutout 2 at the stern end, two fastening means are provided in the form of rubber straps 12*a*, 12*b* which are each fastened to the inside of the stern end of one of the arms 8*a*, 8*b* and which each have a thickening at their free end. The forks 13*a*, 13*b* provided at the stern end of the drive component cooperate with the rubber straps 12*a*, 12*b*. The thickenings of the rubber straps 12*a*, 12*b* engage behind the forks 13*a*, 13*b*.

FIG. 3 shows the drive component 7 according to FIG. 2 inserted into the hull component 1. The rubber straps 12*a*, 12*b* press the drive component 7 against the hull component 1 in the longitudinal direction L and secure it to the hull component 1.

In a second embodiment of the drive component 7, the drive component 7 is formed with two chambers. In both embodiments according to FIG. 2 and FIG. 3, the drive component 7 is impervious to water, that is to say the electrics of the jet drive are encapsulated and sealed against the ingress of water.

In the embodiment shown in FIG. 3, the jet drive is arranged in a stern-side chamber 14*a* while the accumulator is provided in a bow-side chamber 14*b*. Otherwise, the same reference signs denote the same features as in FIG. 2. Plug-in connections 15 are provided between the two chambers 14*a*, 14*b*, which plug-in connections may inter alia also comprise an electrical connection. When the drive component 7 with two chambers is inserted into the cutout 2, the two chambers 14*a*, 14*b* are pressed against one another by the force that the two rubber straps 12*a*, 12*b* exert on the drive component 7 in the longitudinal direction L, a mechanical and electrical connection or contact is established, and thus the two chambers 14*a*, 14*b* are securely held in the cutout 2. A separating surface between the accumulator chamber 14*b* and the jet drive chamber 14*a* may be planar and may have both mechanical and electrical plug-in connections. However, other designs of the separating surface may also be possible, such as for example concave/convex interlocking configurations or other form-fitting connections.

FIG. 4 shows the surfboard according to the invention comprising the hull component 1 made of the drop stitch material and the drive component 7; the tread surface 4 of the surfboard is formed in a planar manner by tread surfaces 4 of the drive component 7 and of the hull component 1.

REFERENCE SIGNS

1 hull component
2 cutout
3 underwater surface
4 tread surface
6 eyelet
7 drive component
8*a* arm
8*b* arm
9 bead
10*a* lateral outer wall
10*b* lateral outer wall
11 bow-end outer wall
12*a* rubber strap
12*b* rubber strap
13*a* fork
13*b* fork
14*a* stern-side chamber
14*b* bow-side chamber
15 plug-in connections
L longitudinal direction

What is claimed is:

1. A surf board, comprising:

an inflatable hull component (1) having a longitudinal direction (L) and, at a stern end, inflatable arms (8*a*, 8*b*) which are spaced apart from one another and which are oriented in the longitudinal direction (L), said arms forming therebetween a receptacle (2) having an inner contour, and a drive component (7) having a tread surface (4) and an underwater surface (3) whereby the tread surface of the drive component (7) is flush with a tread surface of the inflated hull component (1), so that a common total tread surface is formed by the hull component (1) and the drive component (7), which drive component is formed with a complementary contour (10*a*, 10*b*, 11)

on two spaced-apart longitudinal sides (10*a*, 10*b*) and can be inserted into the receptacle (2) from the stern end, wherein the inner contour and the complementary outer contour (10*a*, 10*b*, 11) form a connection with one another and a position of the inserted drive component (7) in the receptacle (2) is fixed in the direction of the tread surface (4) and the underwater surface (3) and laterally, and at least one fastening means (12*a*, 12*b*, 13*a*, 13*b*) for fastening the drive component (7) in the receptacle (2), which fastening means can be opened and closed, is provided at the stern end of the drive component (7) and of the arms (8*a*, 8*b*) and prevents the drive component (7) from slipping out of the receptacle (2) at the stern end.

2. The surf board according to claim 1, wherein the connection forms a form-fitting connection.

3. The surf board according to claim 1, wherein the two arms (8*a*, 8*b*) are convex on their mutually facing inner sides in a cross-section perpendicular to the longitudinal direction (L), and the drive component (7) is concave on the two spaced-apart longitudinal sides (10*a*, 10*b*) so that the concave longitudinal sides (10*a*, 10*b*) engage partially around the convex arms (8*a*, 8*b*) with a form fit.

4. The surf board according to claim 1, wherein the two arms (8*a*, 8*b*) are convex on their mutually facing inner sides along the entire extension thereof in the longitudinal direction (L) in a cross-section perpendicular to the longitudinal direction (L).

5. The surf board according to claim 1, wherein the two arms (8*a*, 8*b*) are circular in cross-section.

6. The surf board according to claim 1, wherein the longitudinal sides (10*a*, 10*b*) engage around the arms (8*a*, 8*b*) in cross-section over at least of the circumference.

7. The surf board according to claim 1, wherein the drive component (7) comprises a jet drive and a rechargeable battery.

8. The surf board according to claim 7, wherein the drive component (7) has at least two chambers (14*a*, 14*b*) which can be separated from one another, and a separating plane runs transversely to the longitudinal direction (L), and the fastening element (12*a*, 12*b*, 13*a*, 13*b*), upon being closed, exerts a force in the longitudinal direction (L) and presses the two chambers (14*a*, 14*b*) against one another.

9. The surf board according to claim 1, wherein in each case at least one fastening means (12*a*, 12*b*, 13*a*, 13*b*) is arranged on each of the arms (8*a*, 8*b*).

10. The surf board according to claim 9, wherein the at least one fastening means comprises an elastic rubber strap (12*a*, 12*b*) with a thickened end which is arranged on the longitudinal sides, and a fork (13*a*, 13*b*) which is arranged on the drive component (7) and which can engage behind the thickened end.

* * * * *